United States Patent [19]

Barten et al.

[11] 4,211,960

[45] Jul. 8, 1980

[54] METHOD OF MANUFACTURING A STATIC CONVERGENCE UNIT, AND A COLOR DISPLAY TUBE COMPRISING A CONVERGENCE UNIT MANUFACTURED ACCORDING TO THE METHOD

[75] Inventors: Piet G. J. Barten; Jan Bijma, both of Eindhoven, Netherlands

[73] Assignee: U.S. Philips Corporation, New York, N.Y.

[21] Appl. No.: 840,271

[22] Filed: Oct. 7, 1977

Related U.S. Application Data

[62] Division of Ser. No. 668,487, Mar. 19, 1976.

[51] Int. Cl.[2] ..... H01J 29/70; H01J 29/76

[52] U.S. Cl. ..... 315/368; 315/13 C

[58] Field of Search ..... 315/368, 13 C, 370; 335/210, 212, 213; 358/10

[56] References Cited

U.S. PATENT DOCUMENTS 4,027,219 5/1977 Van Alphen et al. ..... 335/213

*Primary Examiner*—Theodore M. Blum

*Attorney, Agent, or Firm*—Thomas A. Briody; William J. Streeter; Edward W. Goodman

[57] ABSTRACT

The method according to the invention consists in the determination of data of the convergence errors of a color display tube, data being derived from the said determinations for determining the polarity and the intensity of magnetic poles of a structure. The structure thus obtained generates a static, permanent, multipole magnetic field adapted to the convergence errors occurring, so that the errors are connected.

11 Claims, 11 Drawing Figures

METHOD OF MANUFACTURING A STATIC CONVERGENCE UNIT, AND A COLOR DISPLAY TUBE COMPRISING A CONVERGENCE UNIT MANUFACTURED ACCORDING TO THE METHOD

This is a division of application Ser. No. 668,487 filed Mar. 19, 1976.

The invention relates to a method of manufacturing a magnetic convergence device for the static convergence of electron beams which extend approximately in one plane in a neck of a colour display tube, and to a colour display tube provided with a permanent magnetic device for the static convergence of electron beams in the colour display tube. A known device, described in U.S. Pat. No. 3,725,831, consists of at least four permanent magnetic rings arranged in pairs which generate a magnetic field that can be adjusted as regards position and intensity. The adjustability is obtained by turning the two rings of a pair in the same direction with respect to the electron beams and by turning the one ring in the opposite direction with respct to the other ring. The adjustability necessitates that the rings be arranged on a support which is arranged about the neck of the colour display tube and which should include facilities such that the adjustability of each pair of rings, independent of the position of the other rings, is ensured. The invention has for its object to provide a method whereby a device for converging electron beams can be manufactured which need not be mechanically adjustable, so that it can have a very simple construction, and to provide a colour display tube including such a device.

To this end, the method according to the invention is characterized in that the colour display tube is activated, after which data concerning the extent and the direction of the convergence error of each electron beam are determined, on the basis of which is determined the polarity and intensity of magnetic poles of a structure for generating a permanent, multi-pole, static magnetic field for the correction of the convergence errors occurring in the colour display tube, about the neck of the colour display tube there being provided an auxiliary device for generating variable magnetic fields in the neck of the colour display tube, the auxiliary device being subsequently adjusted such that a magnetic field with converges the electron beams is produced, data being derived from the adjustment of the auxiliary device thus obtained, the said data being a measure for the convergence errors and being used for determining the structure generating the permanent static magnetic field.

Using the described method, a device can be manufactured which generates a magnetic field adapted to the colour display tube and which thus constitutes one unit as if it were with the colour display tube. If desired colour purity errors as well as convergence errors can be eliminated by this method. The convergence errors visible on the screen can be measured and expressed in milimeters of horizontal and vertical errors. The errors thus classified represent data whereby, using magnetic poles of an intensity to be derived from the errors, there can be determined a structure of a magnetic multi-pole which generates a permanent magnetic field adapted to the determined convergence errors.

As a result of the generation of a desired magnetic field by means of an auxiliary device and the derivation of data therefrom, it is possible to determine a device adapted to the relevant colour display tube. Simultaneously, it is ensured that the convergence of the electron beams can be effected.

A preferred version of the method according to the invention is characterized in that for the auxiliary device is used an electromagnetic convergence unit which comprises a number of coils wherethrough electrical currents are conducted in order to generate a magnetic field required for the convergence of the electron beams, the values of the electrical currents producing the data for determining an annular permanent magnetic structure. Because the electrical currents whereby the auxiliary device is actuated are characteristic of the magnetic field generated, the intensity and the position of the poles of the magnetic multi-poles to be used for the colour display tube are determined by the determination of the values of the electrical currents.

The data obtained from the auxiliary device can be used in various manners. The data from the auxiliary device can be stored in a memory, or the data from the auxiliary device can be used immediately for controlling a magnetizing unit which magnetizes an annular magnetizable structure. Alternatively it is possible to convert the data into a code; on the basis thereof an annular permanent magnetic structure having a desired magnetic field strength can be taken or composed from a set of already magnetized structural parts. Obviously, the latter two possibilities can be performed after the data have been stored in a memory.

A simplification of the method is achieved when the device is formed from a magnetizable mass which is provided in the form of a ring on at least one wall of the neck of the colour display tube. The device to be magnetized is thus arranged around the electron beams to be generated. Subsequently, a construction which comprises the auxiliary device and the magnetizing unit is arranged around the neck of the colour display tube. The auxiliary device is then adjusted, after which the construction can possibly be displaced, so that the magnetizing unit encloses the device. The magnetizing unit is actuated on the basis of the data received from the auxiliary device, and magnetizes the device.

In order to make the construction of a magnetizing unit as simple and as light as possible, it is advantageous to polarize material of the structure to be magnetized one area after the other by means of the magnetizing unit. A suitable alternative of the method for which use can be made of the described construction of the magnetizing unit is characterized in that the device consists of a non-magnetizable support and a number of permanent magnetic bipoles. It was found that any feasible magnetic field required for the static convergence of electron beams in a neck of a colour display tube can be comparatively simply generated using at least one eight-pole electromagnetic convergence unit. Similarly, any desired magnetic field can be generated using a twelve-pole electromagnetic convergence unit. It is to be noted that electromagnetic convergence units have already been proposed in U.S. Pat. No. 4,027,219.

The invention will be described in detail hereinafter with reference to a drawing.

Figure 9A:
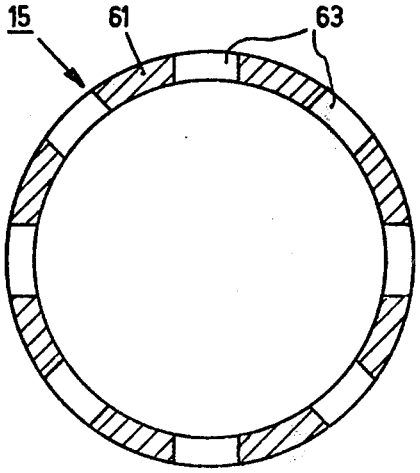

FIG. 9*a* is a cross-sectional view of a convergence unit manufactured using a method according to the invention.

Figure 9B:
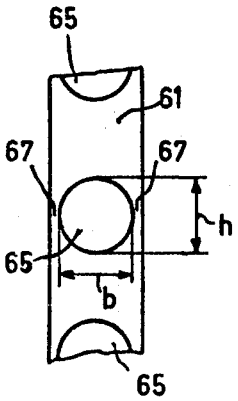

FIG. 9*b* is a partial side elevation of part of a support of the convergence unit shown in FIG. 9*a*.

Figure 9C:
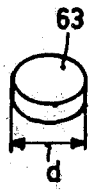

FIG. 9*c* shows a permanent magnetic structural part of the device shown in FIG. 9*a*.

Figure 1:
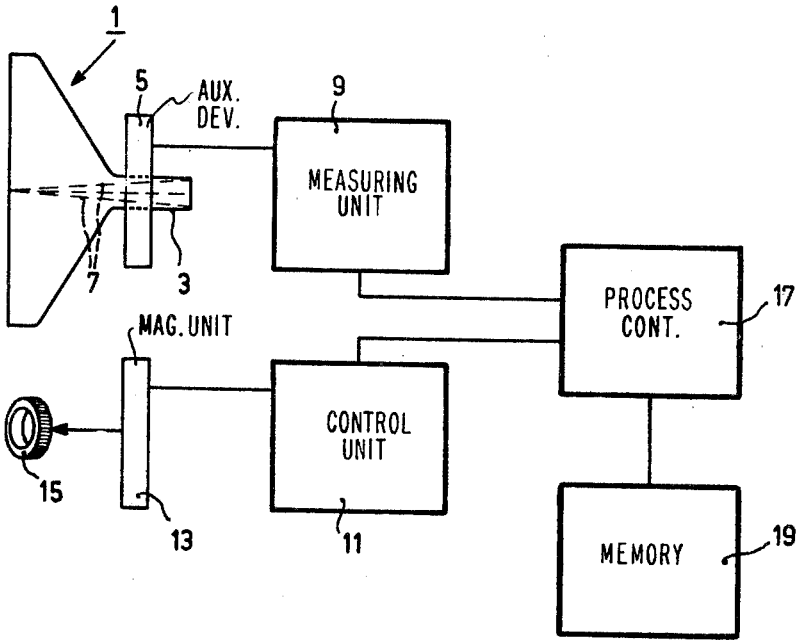
FIG. 1 is a diagrammatic representation of a first version of the method according to the invention.

The method according to the invention will be described with reference of FIG. 1. An electromagnetic auxiliary device 5 is arranged around the neck 3 of the colour display tube 1. The auxiliary device 5 will be described in detail with reference to FIG. 3. Electrical currents which generate a magnetic field are applied to the auxiliary device 5. When the electrical currents are adjusted to the correct value, a magnetic field adapted to the colour display tube 1 as regards position and intensity is generated. The electrical currents are measured by means of the measuring unit 9. The electrical currents represent data which completely describe the magnetic field generated by the auxiliary device 5. The data are stored in a memory 19 (for example, a ring core memory) in an adapted form (digitally). The data can be extracted from the memory 19 again for feeding a control unit 11. The control unit 11 actuates a magnetizing unit 13. A magnetic field is impressed on the device 15 arranged inside the magnetizing unit 13 (shown to be arranged outside this unit in FIG. 1), the said magnetic field equalling the magnetic field generated by the auxiliary device 5 at the area of the electron beams. The auxiliary device 5 is then removed from the neck 3 and replaced by the device 15.

The method is suitable for the application of an automatic process controller 17. The storage of the data in the memory 19, the retrieval thereof, the determination and the feeding of the data to the control unit 11 are operations which are very well suitable for execution by an automatic controller. Similarly, the process controller 17 can dispatch commands at the correct instants to mechanisms which inter alia arrange the auxiliary device 5 on the display tube 1, arrange the device 15 to be magnetized in the magnetizing unit 13, remove the auxiliary device 5 from the display tube 1, and arrange the device 15 on the neck 3 of the display tube 1. Besides these controlling functions, checking functions can also be performed by the process controller, such as the checking of:

the position of the display tube 1 with respect to the auxiliary device 5.

the determination of the number of data by the measuring unit 9.

the actuation of the magnetizing unit 13.

the position of the device 15 with respect to the display tube 1.

Figure 2:
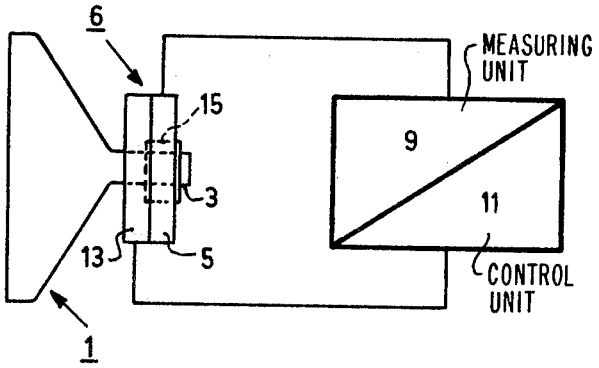
FIG. 2 is a diagrammatic representation of a second version of the method according to the invention.
Figure 3:
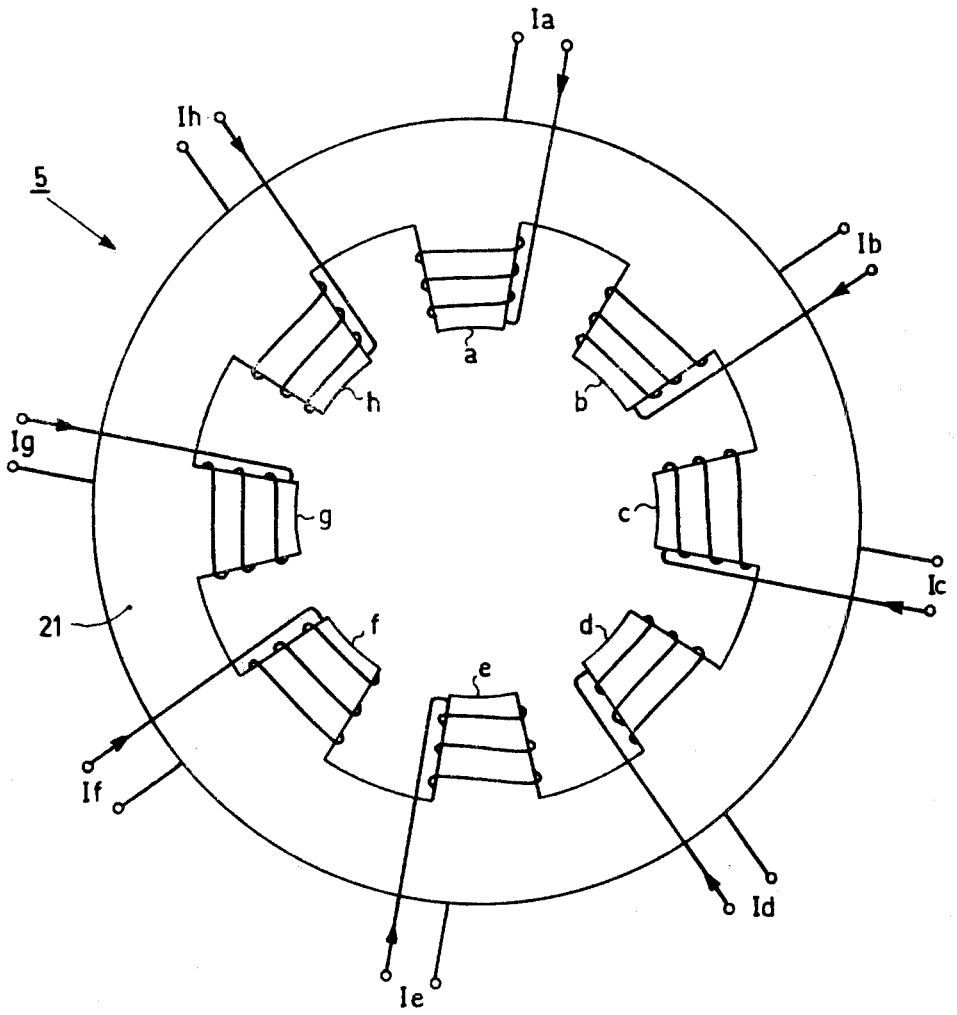
FIG. 3 shows a preferred embodiment of an auxiliary device.

The method shown in FIG. 2 is an alternative to the method described with reference to FIG. 1. The auxiliary device 5 and the magnetizing unit 13 are accommodated together in one construction 6. Before the auxiliary device 5 and the magnetizing unit 13 are arranged around the neck 3 of the colour display tube 1, the as yet unmagnetized device 15 is arranged in a desired position. The auxiliary device 5 is activated and adjuste so that a magnetic field converging the electron beams is produced. Subsequently, the measuring unit 9 determines the necessary data whereby the control unit 11 is adjusted. The auxiliary device 5 may be shifted so that the magnetizing unit 13 encloses the device 15. After the current to the auxiliary device 5 has been interrupted, the magnetizng unit 13 is activated by the control unit 11. After magnetization of the device 15, the auxiliary device 5 and the magnetizing unit 13 are removed. A convergence unit which has been exactly adjusted as regards position and strength has then been arranged on the neck 3 of the tube 1. FIG. 3 more or less diagrammatically shows an embodiment of an auxiliary device 5. The auxiliary device 5 comprises an annular ferromagnetic core 21 having formed thereon eight pole shoes a, b, c, d, e, f, g, and h which are situated in one plane and radially orientated. Each pole shoe has provided thereabout a winding wherethrough a direct current I to be adjusted is to be conducted.

In the space enclosed by the core 21 an eight-pole static magnetic field is generated whose polarity and intensity can be controlled. The value and the direction of the direct currents I*a*, I*b*, I*c*, I*d*, I*e*, I*f*, I*g* and I*h* can be adjusted on the basis of the value and the direction of the deviations of the electron beams to be converged. The corrections required for achieving colour purity and convergence can be derived from the value and the direction of the direct currents I*a* and I*h* which form the data from which the necessary corrections are determined.

A similar embodiment can be used for the magnetizing unit, but because the electrical currents required for converging electron beams are smaller than the currents required for magnetizing the device, the conductors of the coils of the magnetizing unit must be constructed in a different manner which takes account the higher current intensities. If a similar embodiment of the auxiliary device has been made suitable for higher current intensities, it can also operate at lower current intensities. It follows that it is possible also to use the magnetizing unit as the auxiliary device, which is in one case connected to the measuring unit and in the other case to the control unit.

Figure 4:
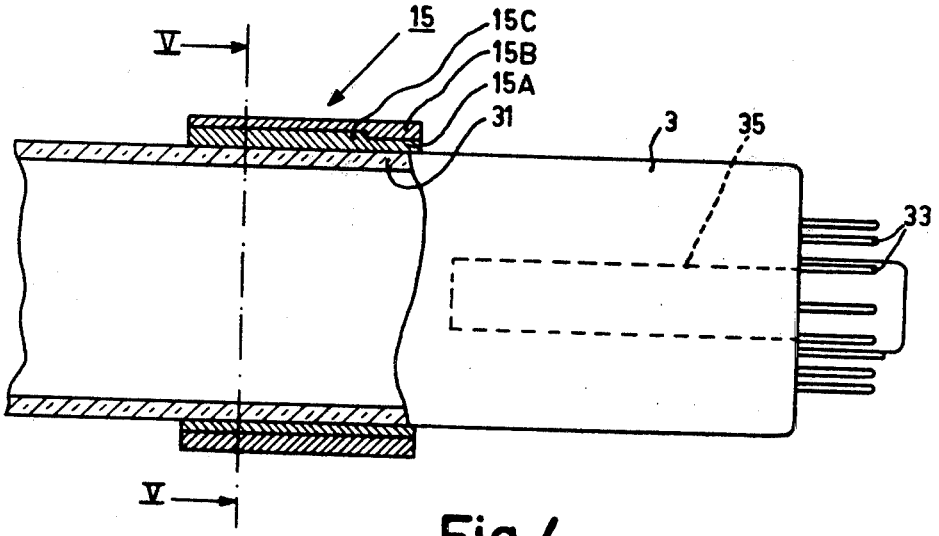
FIG. 4 is a side elevation of a first embodiment of a device manufactured using the method according to the invention.
Figure 5:
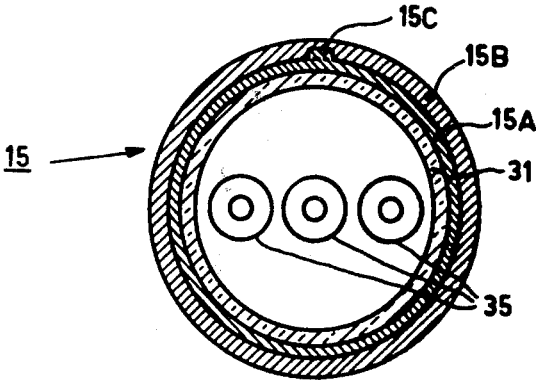
FIG. 5 is a cross-sectional view of the embodiment shown in FIG. 4.

FIG. 4 shows a partly cut-away neck 3 having an envelope 31 of a colour display tube, the flared portion and the adjoining display screen not being shown. At the end of the neck 3 there are provided contact pins 33 to which cathodes and electrodes of the system of electron guns 35 are connected. The device 15 for the static convergence of the electron beams generated by the system of guns 35 consists of a support 15A of synthetic material and a ferrite ring 15B. On the jacket surface of the support 15A is provided a ridge 15*c* which extends in the longitudinal direction; the ferrite ring 15B is provided with a slot which co-operates therewith and which opens into the edge of the ring on only one side, so that the ring 15B can be secured to the carrier 15A in only one way. FIG. 5 is a cross-sectional view which clearly shows the ridge 15C and the slot of the device 15. The references used in FIG. 5 correspond to those used in FIG. 4.

Figure 6:
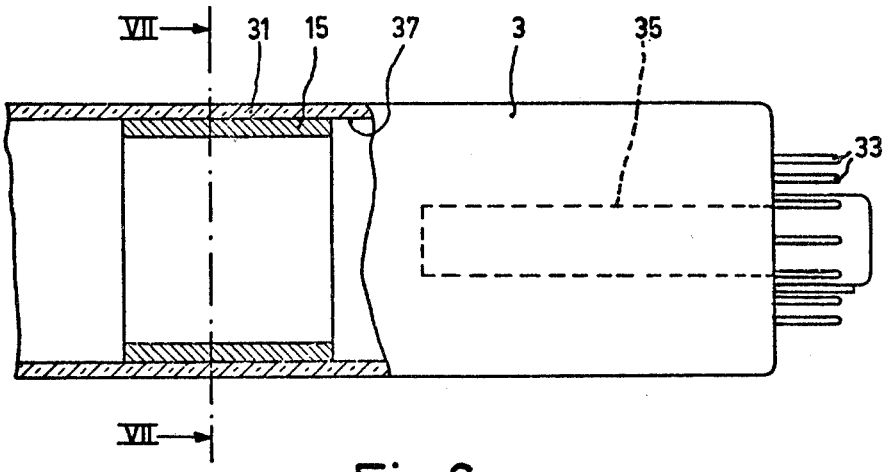
FIG. 6 is a side elevation of a further embodiment of a device manufactured using the method according to the invention.
Figure 7:
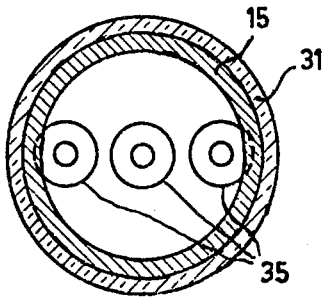
FIG. 7 is a cross-sectional view of the device shown in FIG. 6.

FIG. 6 shows the same portions of the neck 3 of a colour display tube as FIG. 4. Instead of a support on which a ferrite ring is secured, the device consists only of a layer of ferrite 15 which is secured directly to the inner wall 37 of the neck 3 by means of a binding agent. This offers the advantage that a support which requires space and material can be dispensed with. FIG. 7 is a cross-sectional view and illustrates the simplicity of the device 15. The references used correspond to the references of FIG. 6. The device 15 can also be mounted (not shown in the Figure) on the rear of a deflection unit of the colour display tube. It is alternatively possible to arrange the device on grids or on the cathodes in the neck of the colour display tube.

Figure 8:
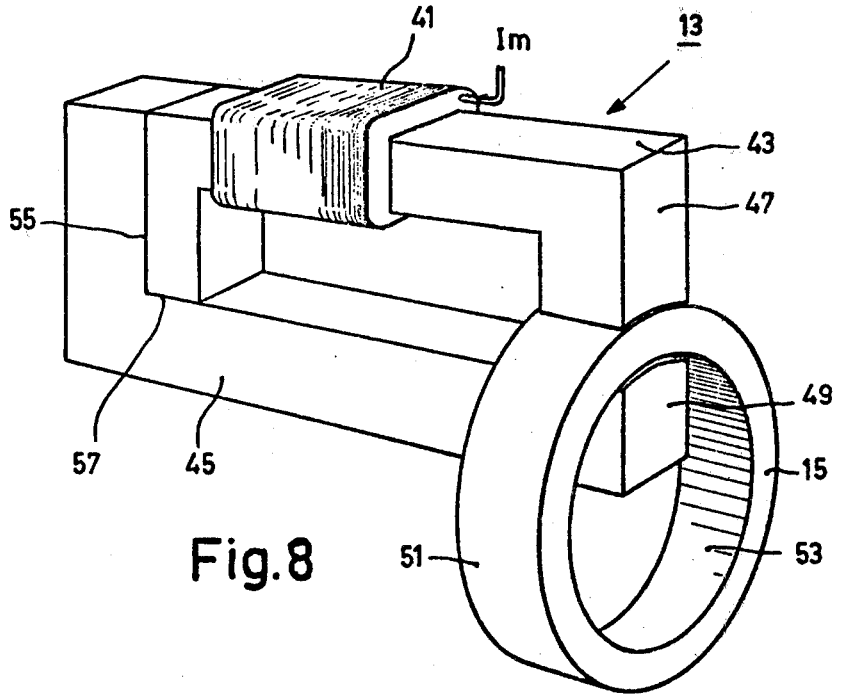
FIG. 8 is a diagrammatic perspective view of a magnetizing device and a convergence unit arranged therein.

FIG. 8 diagrammatically shows a magnetizing unit 13 whereby the device 15 arranged thereon is magnetically polarized one location after the other. The extent of the polarization is dependent of the value and direction of the used direct current I*m* and of the number of ampere-turns of the coil 41 arranged about the core of the magnetizing unit 13. The core consists of two portions 43 and 45 which form a substantially closed magnetic circuit. Between a concave pole shoe 47 and a convex pole shoe 49 of the core portions 43 and 45, respectively, there is a space wherein a portion of the device 15 to be magnetized is arranged. The concave and convex pole shoes 47 and 49 preferably are shaped to follow the curved faces 51 and 53 of the device substantially completely. In order to enable easy arrangement and displacement of the device between the pole shoes 47 and 49, the core portions 43 and 45 are provided with ground contact faces 55 and 57 which are perpendicular to each other. The pole shoes 47 and 49 can be moved away from and towards each other, the core portions 43 and 45 always returning to the same position relative to each other due to the faces 55 and 57 perpendicularly extending to each other. At the same time, the magnetic contact resistance at the faces 55 snd 57 is low and constant, so that the necessary unambiguous relationship between the current I*m* and the magnetic field generated in the core is ensured.

FIGS. 9*a*, *b* and *c* show a preferred embodiment and details of a static convergence device 15. The device 15 consists of a support 61 of synthetic material, for example, polycarbonate, wherein eight ferromagnetic discs (or "inserts") 63 are equidistantly arranged along the circumference. It will be obvious that this embodiment is particularly suitable for being actuated in a magnetizing unit as shown in FIG. 8. The holes 65 provided in the support 61 are slightly elliptical so as to lock the capsules 63 firmly in the holes 65. To this end, the width b is chosen to be slightly smaller than the height h which equals the diameter d of the round discs (or "inserts") 63. The narrow portions 67 of the support 61 with clamp the disc 63 in the hole 65 due to their elastic action. It is, of course, possible to magnetize the disc 63 before they are arranged in the support 61; the sequence in which the disc 63 are arranged in the support 61 should then be carefully checked.

If a method is used where the most suitable structure is selected from a series of permanent magnetic structures on the basis of the adjusting data, it is advantageous to compose this structure from a number of permanent rings. This will be illustrated on the basis of an example involving superimposition of a four-pole field and a six-pole field. Assume that the magnetic fields can each have M different intensities, and that the on field can occupy N different positions with respect to the other field. If the magnetic structure consists of one permanent magnetic ring, the series from which selection can be made consists of $M \times M \times N$ rings. If the structure consists of two rings, the series comprises $M+M$ rings, but it should then be possible for the one ring to be arranged in N different positions with respect to the other ring. If the static convergence device is composed as shown in FIG. 9*a*, *b* and *c* or similar, only M kinds of structural parts (discs) having a different magnetical intensity are required for achieving any desired structure.

What is claimed is:

1. A method of producing a magnetic convergence structure for the static convergence of electron beams which extend approximately in one plane in a neck of a color display tube of the kind in which the neck merges into a flared portion adjoined by a display screen, said method comprising providing around the neck of the color display tube an auxiliary device for generating variable magnetic fields in the neck of the color display tube, activating the color display tube, adjusting the auxiliary device to produce a magnetic field for converging the electron beams, determining from data derived from the adjustment of the auxiliary device the extent and the direction of the convergence error of each electron beam, and using such data to determine the polarity and the intensity of magnetic poles of said magnetic convergence structure for generating a permanent multi-pole static magnetic field for the correction of the convergence errors occuring in the color display tube.

2. A method as claimed in claim 1, wherein the auxiliary device comprises an electromagnet convergence unit which comprises a number of coils, said generating step comprising passing electrical currents through said coils for generating a magnetic field required for the static convergence of the electron beams, and said determining step comprising using the values of the electrical currents for determining the permanent magnetic structure.

3. A method as claimed in claim 2, further comprising storing the data from the auxiliary device in a memory.

4. A method as claimed in claim 2, wherein said using step comprises controlling a magnetizing unit for magnetizing an annular magnetizable convergence structure.

5. A method as claimed in claim 2, further comprising converting the data into a code, and constructing said annular permanent magnetic convergence structure having a desired magnetic field strength from a set of previously magnetized structural parts.

6. A method as claimed in claim 1, further comprising forming the convergence structure from a magnetizable mass which is annularly arranged on at least one wall of the neck of the color display tube.

7. A method as claimed in claim 1, further comprising forming the convergence structure from a magnetizable ring which is arranged on the neck of the color display tube.

8. A method as claimed in claim 1, wherein the convergence structure comprises a non-magnetizable support and a number of permanent magnetic dipoles.

9. A method as claimed in claim 4, wherein said magnetizing step cofmprises polarizing the magnetizable material of the annular convergence structure at one location after the other by means of the magnetizing unit.

10. A method as claimed in claim 4, further comprising assemblying the auxiliary device and the magnetizing unit in one construction, and then enclosing a convergence structure to be magnetized with said magnetizing unit.

11. A method as claimed in claim 10, further comprising displacing said construction with respect to said tube after said determining step.

* * * * *